US005153944A

United States Patent [19]

Teel

[11] Patent Number: 5,153,944

[45] Date of Patent: Oct. 13, 1992

[54] METHOD OR PROCESS OF CONVERTING PANTS TO CONVERTIBLE PANTS AND SHORTS

[76] Inventor: Howard Teel, Box 59, Randolph St., Great Bend, Pa. 18821

[21] Appl. No.: 775,857

[22] Filed: Oct. 15, 1991

[51] Int. Cl.[5] ..... A41D 15/00

[52] U.S. Cl. ..... 2/243 R; 2/79; 2/227; 2/243 R; 2/269; 2/275; 2/DIG. 6

[58] Field of Search ..... 2/79, 227, 269, 243 R, 2/275, DIG. 6, 75, 80, 114, 239, 240, 241, 242, 244, 243 B

[56] References Cited

U.S. PATENT DOCUMENTS

| | | | |
|---|---|---|---|
| 1,489,046 | 4/1924 | Thompson | 2/269 |
| 2,104,826 | 1/1938 | Stramiello | 2/269 |
| 2,308,411 | 1/1943 | Wolfson | 2/269 |
| 2,462,361 | 2/1949 | Cassens | 2/243 R |
| 3,266,057 | 8/1966 | Phelps | 2/227 |
| 4,190,908 | 3/1980 | Herskind | 2/227 X |
| 4,215,435 | 8/1980 | Miele | 2/227 |
| 4,697,288 | 10/1987 | Palumbo | 2/243 R X |
| 4,697,362 | 10/1987 | Wasserman | 2/DIG. 6 X |
| 4,766,613 | 8/1988 | Wells | 2/DIG. 6 X |
| 4,987,610 | 1/1991 | Hunt | 2/DIG. 6 X |

FOREIGN PATENT DOCUMENTS

| | | | |
|---|---|---|---|
| 1803765 | 10/1968 | Fed. Rep. of Germany | 2/227 |
| 2616547 | 11/1977 | Fed. Rep. of Germany | 2/227 |
| 3008200 | 9/1981 | Fed. Rep. of Germany | 2/227 |
| 1363957 | 5/1964 | France | 2/227 |
| 1396798 | 3/1965 | France | 2/240 |
| 1527082 | 5/1968 | France | 2/240 |
| 2433309 | 4/1980 | France | 2/DIG. 6 |
| 2449414 | 10/1980 | France | 2/227 |
| 446232 | 3/1968 | Switzerland | 2/240 |
| 1589300 | 5/1981 | United Kingdom | 2/227 |

OTHER PUBLICATIONS

Leaf Chronicle, P. N. R. #1108, May 31, 1971 Clarksville, Tenn. "Hemline? You Decide the Length".

Clifton, N. J. Journal, P. N. R. #1100, Feb. 8, 1971.

*Primary Examiner*—Werner H. Schroeder
*Assistant Examiner*—Jeanette E. Chapman
*Attorney, Agent, or Firm*—Randall L. Reed

[57] ABSTRACT

A process or method for altering pants so that they can be used either as shorts or long pants. The process comprises taking a pair of long pants and marking a predetermined length for shorts around the circumference of the legs at the predetermined length. Permanently attaching a first fastener strip to the circumference of the leg of the pants at the predetermined length for shorts. Cutting the first fastener strip and pants along the center of the first fastener strip so that the first fastener strip is cut in half at its center and the pants are cut leaving two separate severed lower leg portions which have half of the first fastener strips at the top edge and an upper pants portion forming shorts which has half of the first fastener strip at the bottom edge of each leg portion of the shorts. Taking a second fastener strip and attaching it to the first fastener strip at the bottom edge of each leg of the shorts to form shorts. Taking the lower leg portion of the pants and aligning the first half of the first fastener strip to the lower leg portion of the pants with half of the first fastener strip at the base of the shorts and attaching the second fastener strip around the joined first fastener strips to convert the garment to long pants.

14 Claims, 1 Drawing Sheet

METHOD OR PROCESS OF CONVERTING PANTS TO CONVERTIBLE PANTS AND SHORTS

FIELD OF INVENTION

The invention described relates to the field of wearing apparel, specifically to a process or method that allows one to alter a garment such as a pair of pants so that they can be quickly and easily convertible between full length pants or shorts for use either as pants or shorts.

BACKGROUND OF INVENTION

There have been substantial number of patents in the area concerning convertible wearing apparel and specifically with respect to pants which can also be converted to shorts. Although there are many patents existing with respect to pants which are convertible between pants and shorts, there appears to be no easy and efficient method for an individual to alter a pair of pants already owned so that he or she can easily and quickly convert them between pants and shorts. All of the current art is drawn to pants originally manufactured as a convertible garment.

It is the object of this invention then to provide a means for altering pants so that they can be not only used as shorts but as long pants at the discretion of the owner which can be easily and efficiently converted between long pants and shorts. Based on the current art, if one wants to turn a pair of pants into shorts, it involves cutting off the leg of the pants at the appropriate position for shorts of a predetermined length. Once this is done, the pants can be used as shorts. However they cannot be converted back for use as long pants. Additionally a substantial amount of material is left over which generally must be thrown away or is only suitable for use as rag material.

Although there are a number of issued patents drawn to convertible pants, there appears to be no such garments manufactured in large numbers or widely distributed. Consequently, if one desires such a product such as a garment that is convertible between a long pants configuration and a short configuration in a quick and easy manner they are unable to obtain such a product. Give the variability in the weather in many part of the country, particularly the late spring, summer and early fall such a convertible garment would be very useful and functional. Also with the proper designing such a garment could result in a very sheik and fashionable one.

SUMMARY OF THE INVENTION

The current invention solves the above noted problems by providing a method which allows one to alter a pair of pants so that they can be either used as shorts or long pants. The method of altering the garment once completed also provides for a quick and easy means for conversion between either use as shorts or long pants quickly and effectively without the need for devices or machines or equipment other than the shorts and the lower leg portions.

The current invention involves taking a pair of pants and determining at what point on the leg you want the shorts to terminate. Then taking Velcro* strips both the soft or loop portion which is a strip with what appears to be a fuzzy material on one side (this will be referred to as the loop portion or loop strip herein) and the strip with hard or stiffer projections or hooks on it (this will be referred to as the hook portion or hook strip herein). Taking a length of the Velcro loop portion or soft portion that is equal to the circumference of the pants at that line on the pants which will mark the predetermined length of the shorts and permanently attaching the loop strip around and along the line which is the predetermined length of the shorts configuration of the garment. The loop strip can be permanently secured by sewing, ironing with appropriate adhesive or some other method that would permanently affix it. The next step is to cut the loop strip exactly in half along its length and at the same time cut the lower portion of the pant leg off at the line which is the predetermined length for the shorts. This leaves a loop strip of half the width of the original loop strip at the bottom of the shorts, in effect forming a bottom hem on the shorts. It also leaves at the top of the lower leg section which has been cut off the other half of the loop strip. The hook portion or hook strip is not cut and is left intact. On the exterior side of the hook strip a patterned material can be added for a decorative effect. To use the pants as shorts, you merely attach the hook strip to the remaining portion of the loop strip at the bottom of the shorts. To convert the garment back to full length pants, you take the lower portions of the leg which have already been cut off and which have half of the loop strip attached to the top and line it up with the bottom of the shorts with the hook strip removed. You then attach the hook strip to the loop strip on the lower hem of the shorts and at the same time to the loop strip attached to the upper edge of the lower pant leg portion; the lower pant leg being lined up in its original position before being cut.

*Velcro is a registered trademark of the Velcro USA, Inc.

Obviously the process for converting them back into shorts is merely removing the hook strip and taking off the lower leg portions and reattaching the hook strip to the loop strip at the hem of the shorts.

DESCRIPTION OF THE PREFERRED EMBODIMENT

In the preferred embodiment one of the primary types of garments that would be converted would probably be a pair of denim jeans. However any other types of long pants can be used.

As noted in the Summary of the Invention, Velcro is a registered trade name of the Velcro USA, Inc. The product manufactured under the trade name Velcro by Velcro USA, Inc. consists of two different types of material which act as fasteners or connectors when joined together they adhere to each other. When the two different types of material are attached to different items and then the items are joined at the spot that the material is located, the two items become fastened together and can only be separated by appropriate application of force. One of the materials, the softer of the two, is often referred to generically as loop material based on its function. And the other material is referred to generically as hook material. Basically, the hook material consists of a series of a very minute hooks arranged in a form of a mat. The mat which the hook material makes up is generally of an equal area to the mat made up of the softer or loop material. When the hook material is brought into contact and forced into the loop material, the hooks adhere to and hold the loop material creating a connection which can only be broken by applicable force to pull them apart. There are other manufacturers of this type of two part fastener which generically refer to the device as a hook and loop material or a hook and loop fastener. The process described in this invention uses hook and loop material manufactured in long thin strips, generally from ¾' in width to an 1½' to 2' in width and 1 or more feet in length. The fastening material is on one side of each strip. These strips can be purchased in most fabric stores. In the description of this invention, the two strips when together will be referred to as fastener strips and to distinguish the two without specifically referring to either one they will be referred to first fastener strip when it is the strip that is attached permanently to the garment to both the lower leg portion and the upper portion and second fastener strip which is not cut in half and attaches to the two halves of the first fastener strip to hold the lower and upper portion together In this description when reference has to be made to the particular type of strip they will be referred to respectively as a loop strip which contains the softer material and the hook strip which contains the harder material.

Figure 1A:
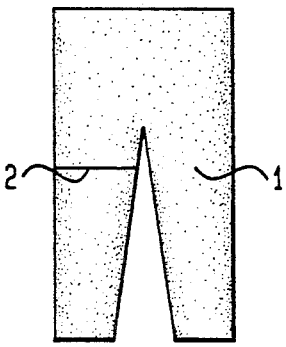
FIGS. 1*a*–1*d* show the respective steps which must be taken in order to alter a pair of long pants to make them convertible between shorts or long pants.

The pants 1 FIG. 1*a* which are to be altered are laid out on a flat surface such as an ironing board and the line 2 at which the bottom of the shorts is to be located is measured and marked. This would generally be at an appropriate point above the knee. The actual step for determining the predetermined length might be done while the pants are being worn and based on the preference of the owner of the pants.

Figure 1B:
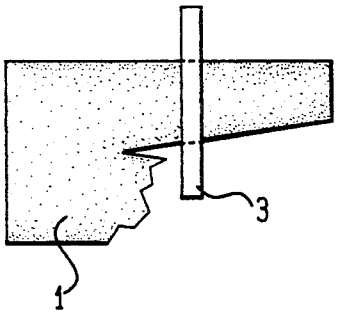

The next step as illustrated in FIG. 1*b* is to measure around the circumference of the pants at the line which has been chosen as the predetermined length of the shorts. Then the appropriate fastening device or material the same or similar to material manufactured under the trade name Velcro in the form of a long strip is cut equal in length to the circumference of the pants around the line which marks the predetermined length of the shorts.

Figure 1C:
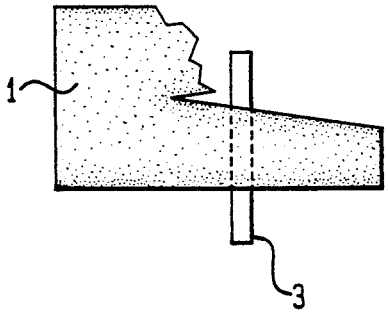

Referring to FIG. 1*b* and 1*c*, with the pants still on the flat surface or ironing board, take a first fastener strip, in the preferred embodiment this would be the loop strip, place it on top of the leg at the predetermined length of your shorts with an equal amount of the loop strip hanging over each side of the leg. If it is to be sewn on, pin it to the leg at the position it is resting on top of the leg and commence sewing it in place. Continue sewing the loop strip on until both ends of the loop strip meet on the opposite side of the pant leg. Both the top edge and bottom edge should be sewn to the leg. Care should be taken to make sure that the ends of the loop strip meet each other on the opposite side of the leg in a flush fit. Additionally, the first fastener strip 3 should be permanently attached to the pants in a multitude of spots between the top edge of the first fastener strip and its bottom edge. Some of the fastener strips have an adhesive on the side opposite the fasteners material to allow the strips to be attached by ironing. When the iron on type of strip is used, the manufacturers instructions should be followed in attaching the strip to the pant leg at the appropriate spot. However, care must be taken to assure when it is ironed on that the ends of the first fastener strip meet on the opposite side of the pants. When attaching the first fastener strip 3 under either method, alignment of the strip around that portion that is to form the lower edge of the shorts is of particular importance. If it is not properly aligned, the shorts will not terminate in an even end.

Figure 1D:
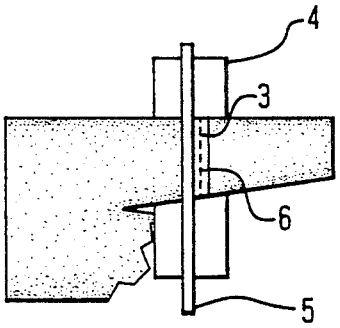

In the next step as in FIG. 1*d*, a piece of wood 4 or other material or device which can be used as a cutting surface is laid underneath the portion to the leg which has the first fastener 3 strip attached. The portion of the first fastener strip on the top is then lined up with the portion of the first fastener 3 strip underneath. It is particularly important that the sections of the first fastener strip 3 on top and underneath be aligned perfectly so that when the material is cut in the next step there are two separate strips of equal width. Mark the center of the strip with line 6. Take a ruler, yard stick or some other long straight edge 5, lay it on top in the center of the width along the center line 6*d* of the strip and secure all so that it cannot be moved. Then take a utility knife or some other sharp means of cutting and cut through the strip and pants along line 6 which marks the center of the strip. The lower portion of the leg is now detached. If the procedure is done properly, there will be two separate strips of first fastener material of equal width and length one 3A on the bottom of the shorts 9 which forms a hem and one 3B on the lower detached portion of the leg 8.

Figure 2A:
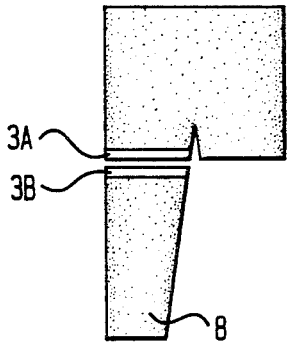
FIG. 2*a*, 2*b*, & 2*c* illustrate the steps of conversion of the garment between pants and shorts.
Figure 2B:
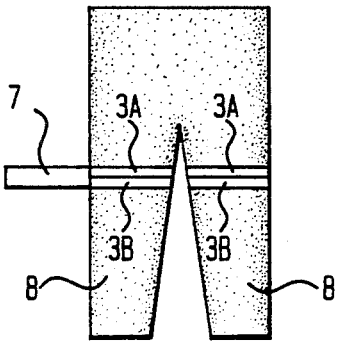
Figure 2C:
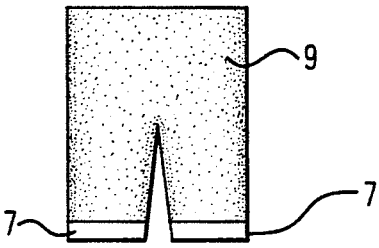

The second fastener strip 7 is not cut; however, for decorative purposes attached to the second fastener strip in this case the hook strip, onto the flat side opposite the side on which the hook material is located a patterned or colored material can be added. If the garment is to be used as shorts, attach the second fastener strip 7 with the decorative band to the first fastener strip 3A on the lower portion of the shorts FIGS. 2*a* and 2*c*. In order to convert the shorts back into pants, the second fastener strip is removed and the first fastener strip of the lower leg portion 3B is aligned with the first fastener strip on the shorts 3A FIG. 2*b*. The second fastener strip 7 FIG. 2*b* is then attached to both the first fastener strip 3A on the shorts as well as the first fastener strip 3B on the upper side of the lower leg portion around the entire circumference of the shorts and lower leg portions. In attaching the second fastener strip 7, care should be taken to make sure the second fastener strip 7 makes complete and firm contact with the first fastener strips 3A and 3B and completely covers both the upper first fastener strip 3*a* and the lower first fastener strip 3*b*. The whole process can be readily automated and performed by a machine.

I claim:

1. A method or process for altering a garment so that it can be used either as shorts or long pants comprising:

taking a pair of long pants and marking a predetermined length for shorts around the circumference of the legs at the predetermined length, permanently attaching a first fastener strip to the circumference of the leg of the pants at the predetermined length for the shorts, cutting the first fastener strip and pants along the center of the first fastener strip so that the first fastener strip is cut in half at its center and the pants are cut leaving two separate and severed lower leg portions which have half of the first fastener strip at their top edge and an upper pants portion forming shorts which has half of the first fastener strip at the bottom edge of each leg portion of the shorts, taking a second fastener strip and attaching it to the first fastener strip at the bottom edge of each leg of the shorts to form shorts, and taking the lower leg portion of the pants and aligning the first half of the fastener strip on the lower leg portion of the pants with the half of the first fastener strip at the base of the (shorts and attaching the second fastener strip over the aligned first fastener strips to convert the garment to long pants.

2. A method for altering a garment to be used both as long pants and shorts as in claim 1 with the means for attaching the first fastener strip is by sewing the same to the garment.

3. A method for altering a garment to be used both as long pants and shorts as in claim 1 where the first fastener strip is attached by adhesive to the garment.

4. A method for altering a garment to be used both as long pants or shorts as in claim 1 where on the outside portion of the second fastener strip decorative material is attached.

5. A method for altering a garment to be used as long pants or shorts as described in claim 1 where the first fastener strip is a loop strip and the second fastener strip is a hook strip.

6. A method for altering a garment to be used as long pants or shorts as described in claim 1 where the first fastener strip is a hook strip and the second fastener is a loop strip.

7. The method of claim 1 wherein the long pants altered are jeans.

8. A method or process for an individual to alter an existing garment so that it can be used either as shorts or long pants comprising:

taking an existing pair of long pants and marking a predetermined length for shorts around the circumference of the legs at the predetermined length, permanently attaching a first fastener strip to the circumference of the leg of the pants at the predetermined length for the shorts, cutting the first fastener strip and pants along the center of the first fastener strip so that the first fastener strip is cut in half at its center and the pants are cut leaving two separate and severed lower leg portions which have half of the first fastener strip at their top edge and upper pants portion forming shorts which has half of the first fastener strip at the bottom edge of each leg portion of the shorts, taking a second fastener strip and attaching it to the first fastener strip at the bottom edge of each leg of the shorts to form shorts, and taking the lower leg portion of the pants and aligning the first half of the fastener strip on the lower leg portion of the pants with the half of the first fastener strip at the base of the shorts and attaching the second fastener strip over the aligned first fastener strips to convert the garment to long pants.

9. The method of claim 8 wherein the means for attaching the first fastener strip is by sewing the same to the garment.

10. The method of claim 8 wherein the first fastener strip is attached by adhesive to the garment.

11. The method of claim 8 wherein the outside portion of the second fastener strip decorative material is attached.

12. The method of claim 8 wherein the first fastener strip is a loop strip and the second fastener strip is a hook strip.

13. The method of claim 8 wherein the first fastener strip is a hook strip and the second fastener is a loop strip.

14. The method of claim 8 wherein the long pants altered are jeans.

* * * * *